United States Patent [19]

Cieniawa et al.

[11] 3,980,380

[45] Sept. 14, 1976

[54] ELECTRICAL CONNECTORS WITH PLURAL SIMULTANEOUSLY-ACTUATED INSULATION-PIERCING CONTACTS

[75] Inventors: Edward A. Cieniawa, Claredon Hills; Vincent J. Palecek, Cicero, both of Ill.

[73] Assignee: Bunker Ramo Corporation, Oak Brook, Ill.

[22] Filed: Nov. 7, 1975

[21] Appl. No.: 629,970

Related U.S. Application Data

[63] Continuation of Ser. No. 308,634, Nov. 21, 1972, abandoned.

[52] U.S. Cl. ..... 339/99 R; 339/103 C; 339/174

[51] Int. Cl.[2] ..... H01R 9/08; H01R 13/58

[58] Field of Search ..... 339/49, 89–91, 339/97–99, 103, 107, 174, 154, 156, 184, 186, 201, 206, 207, 209, 213

[56] References Cited

UNITED STATES PATENTS

| | | | |
|---|---|---|---|
| 1,898,359 | 2/1933 | Gilbert | 339/99 R |
| 1,953,594 | 4/1934 | Douglas | 339/187 |
| 2,183,651 | 12/1939 | Langston et al. | 339/91 R |
| 2,700,140 | 1/1955 | Phillips | 339/89 M |
| 2,739,291 | 3/1956 | Frankel | 339/99 L |
| 3,017,602 | 1/1962 | Little | 339/174 |
| 3,181,105 | 4/1965 | Roach et al. | 339/94 R |
| 3,323,096 | 5/1967 | Appleton | 339/89 M |

FOREIGN PATENTS OR APPLICATIONS

| | | | |
|---|---|---|---|
| 566,668 | 4/1958 | Belgium | 339/107 |
| 1,495,205 | 8/1967 | France | 339/99 R |
| 1,515,938 | 11/1969 | Germany | 339/186 M |
| 716,686 | 10/1954 | United Kingdom | 339/98 |
| 1,000,554 | 8/1965 | United Kingdom | 339/75 M |

*Primary Examiner*—Joseph H. McGlynn
*Attorney, Agent, or Firm*—William Lohff; F. M. Arbuckle

[57] ABSTRACT

An electrical connector unit comprising a molded dielectric insert having a plurality of conductive contact members mounted in longitudinal contact passages spaced around the periphery of the insert; each contact member includes an active contact element located at one end of the contact passage and an insulation-piercing self-connection terminal element that projects into a transverse terminal guide slot at the other end of the contact passage The dielectric insert further includes a corresponding plurality of blind-end conductor retainer apertures, each intersecting one of the terminal guide slots, into which insulated wire conductors are inserted. The terminal elements of the contact members are all simultaneously actuated into connection with the wires, either by mounting the insert in a housing which cams the terminals into the wires, or by rotating two parts of the insert relative to each other. In either case, a housing is provided which interlocks all of the contact terminal elements in actuated condition and hence in electrical connection with their respective conductors.

20 Claims, 24 Drawing Figures

Fig.14
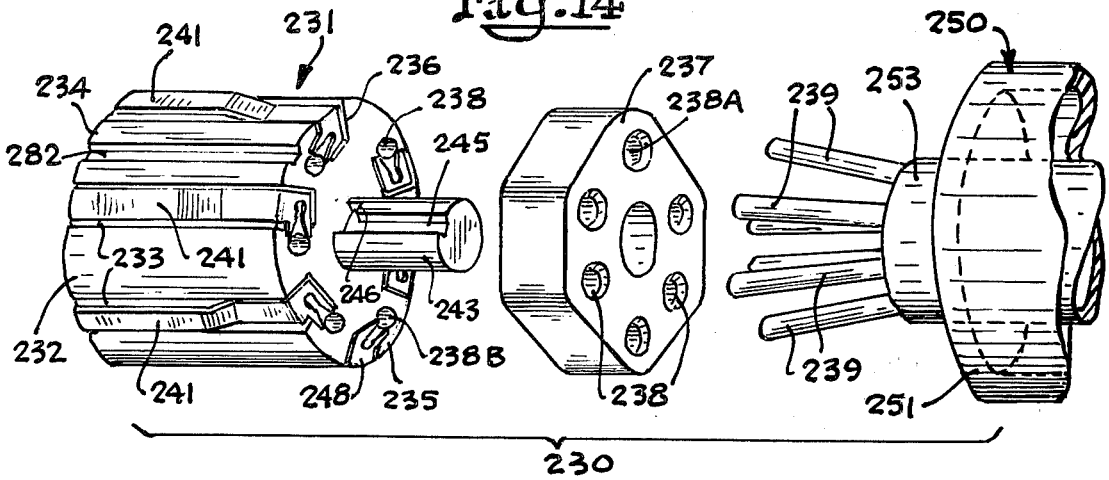
Fig.15
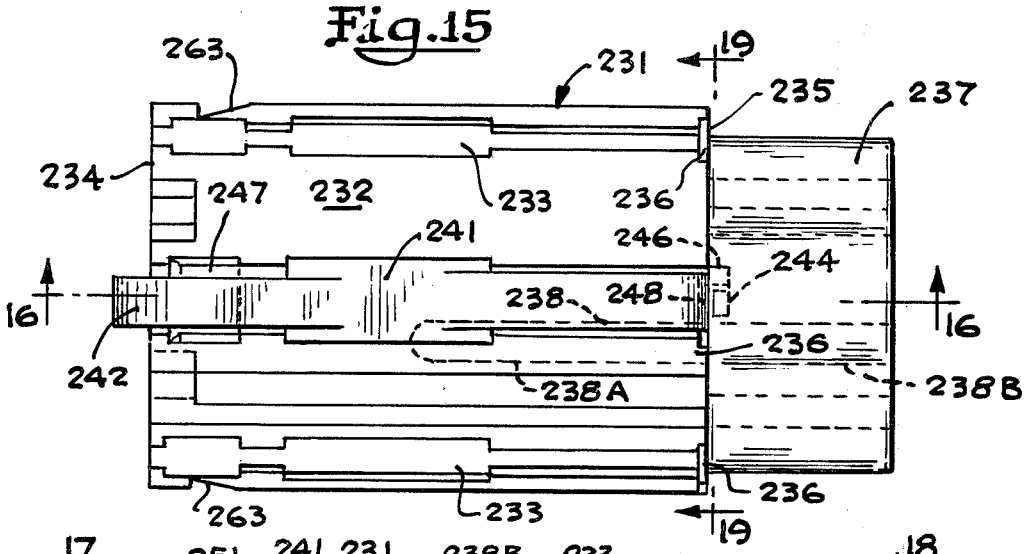
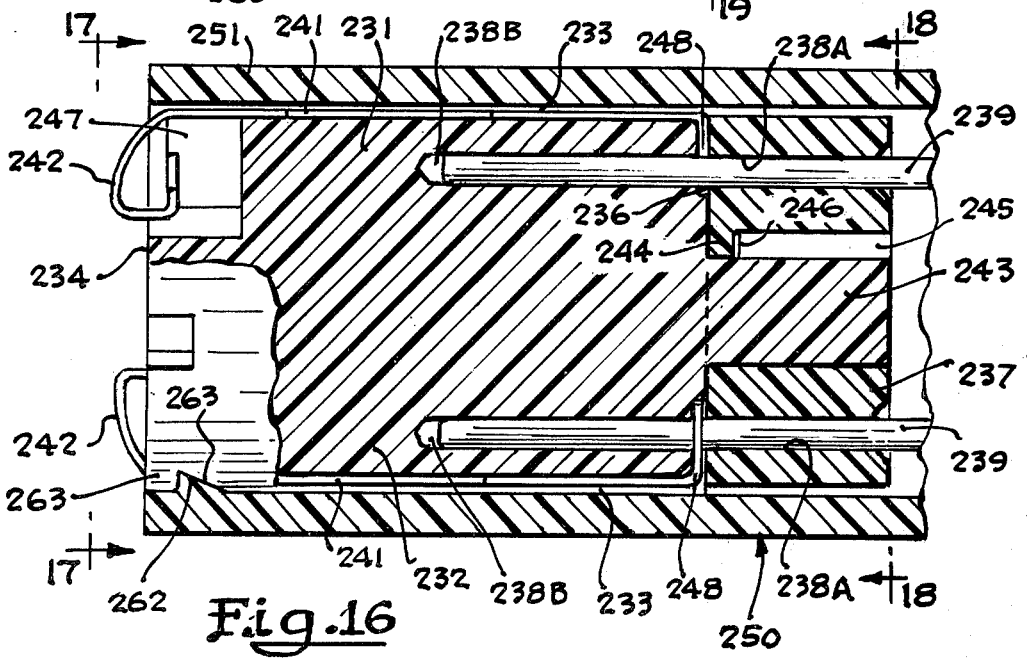
Fig.16

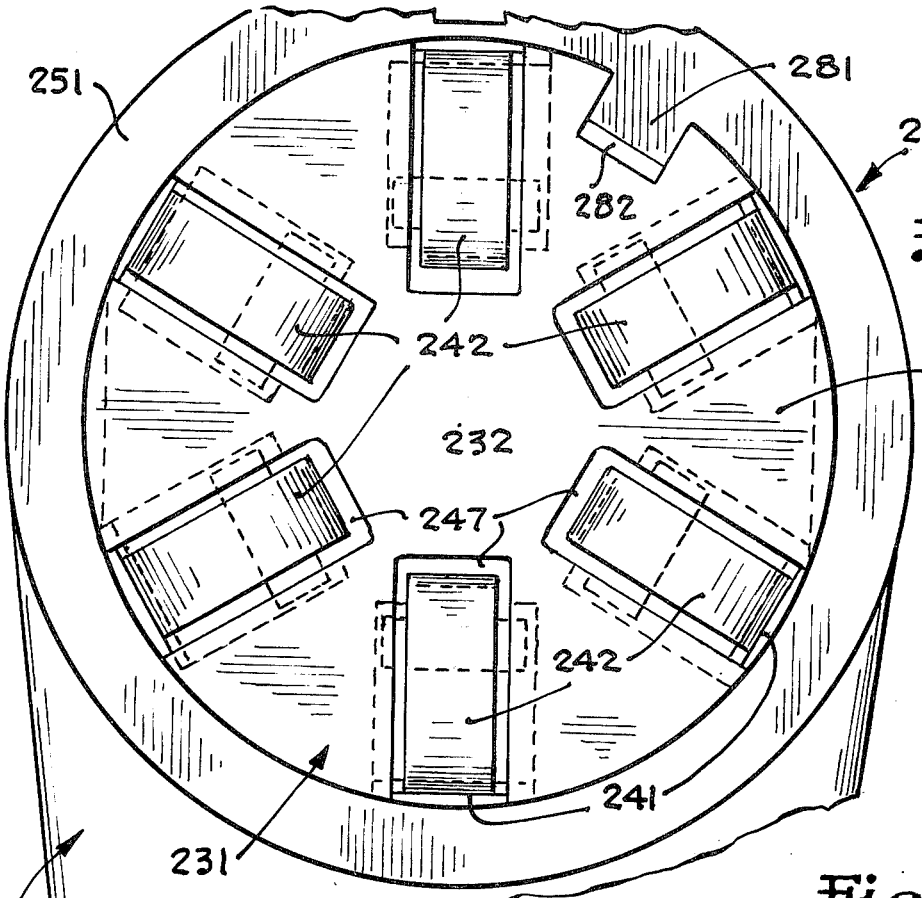
Fig.17
Fig.18
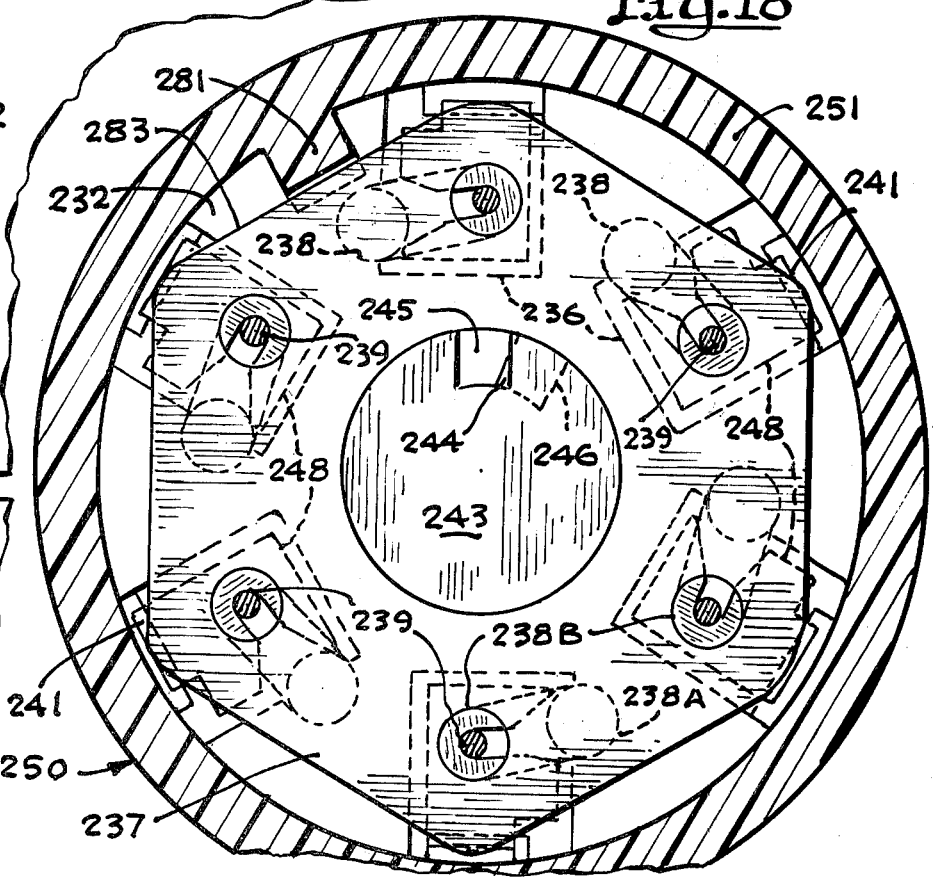

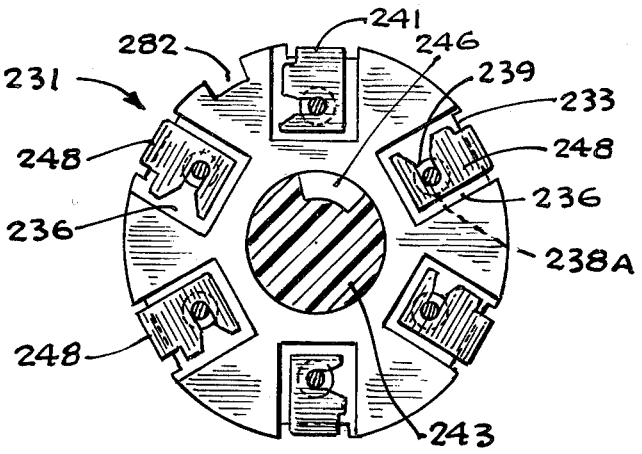
Fig. 19
Fig. 20
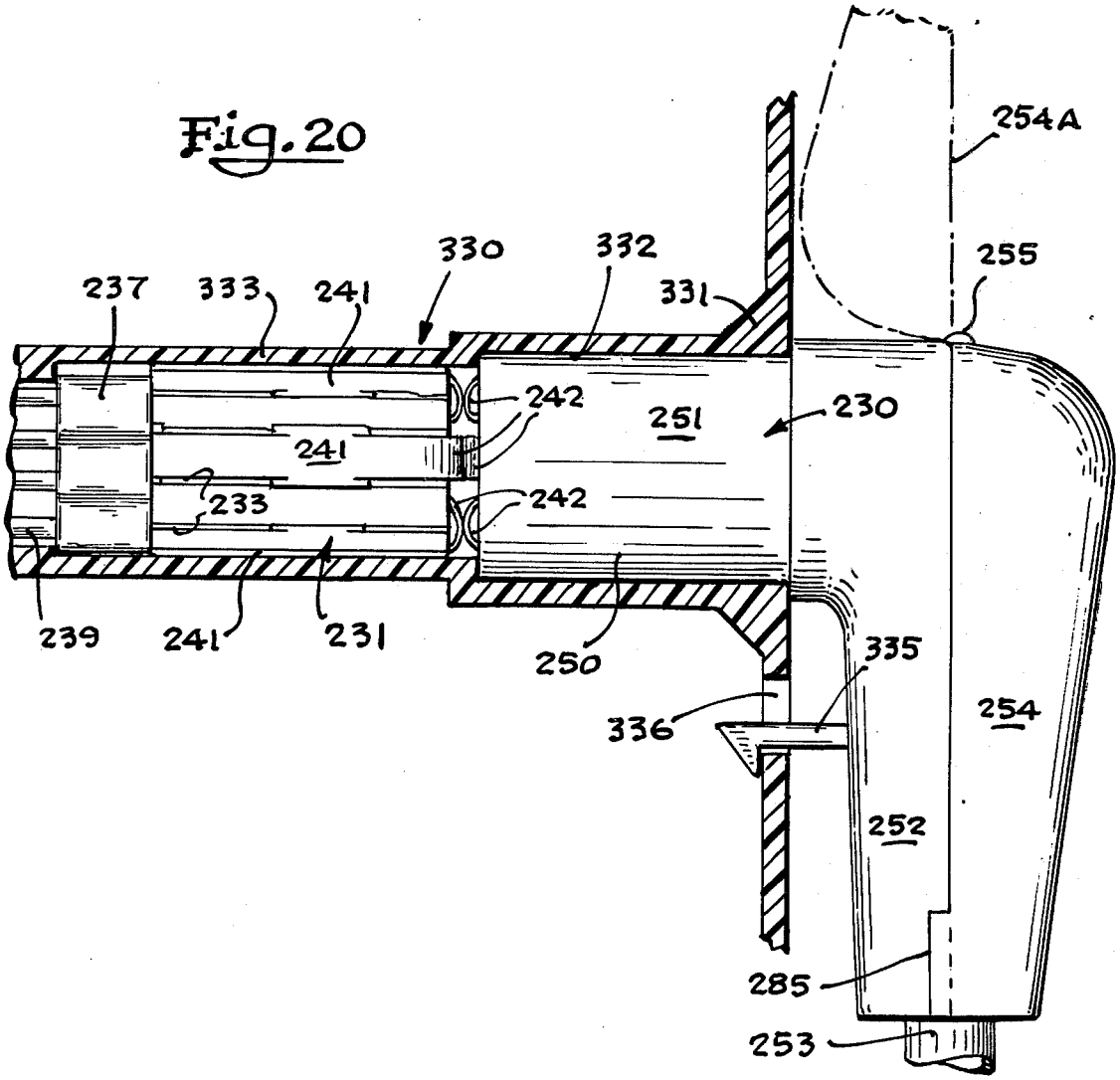

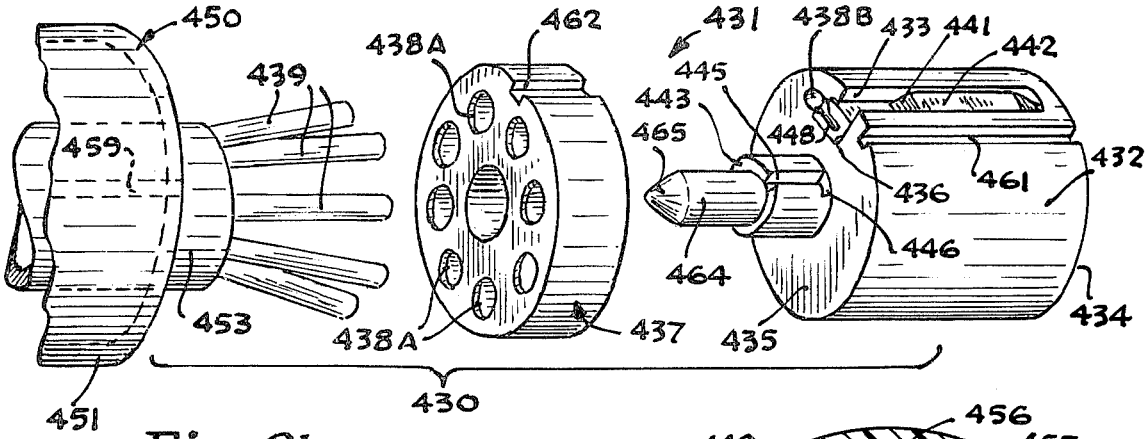
Fig. 21
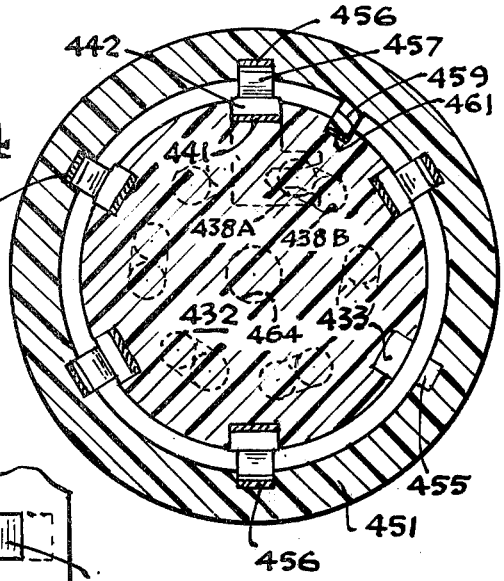
Fig. 24
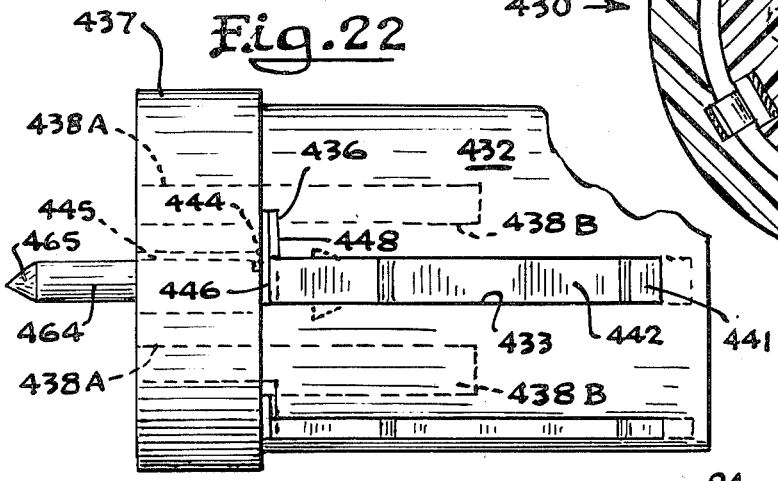
Fig. 22
Fig. 23
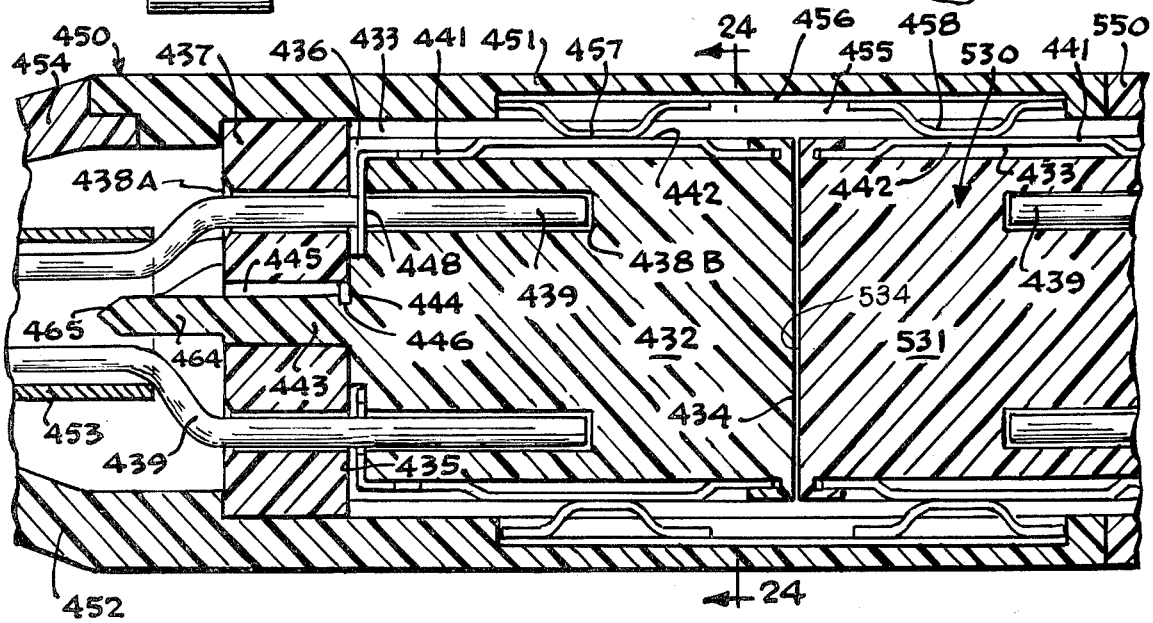

ELECTRICAL CONNECTORS WITH PLURAL SIMULTANEOUSLY-ACTUATED INSULATION-PIERCING CONTACTS

This is a continuation application of application Ser. No. 308,634, filed Dec. 21, 1969, now abandoned.

BACKGROUND OF THE INVENTION

In multiple-circuit electrical connectors, of the kind used in great variety and numbers in telephone systems and in other communication and data handling systems, the usual method of connecting the individual circuit conductors to a connector unit has been to strip the insulation from the end of the conductor wire and then solder the conductor to a connector contact. This technique requires considerable skill on the part of the workman making the solder connections, particularly in miniaturized connectors and especially when field connections are required. Whether the connections are made in a shop location or in the field, there is always some tendency to bridge adjacent contacts of the connectors, during the soldering operation, producing incorrect and undesired circuit connections.

An alternative to the conventional soldered connection, gaining increasingly in acceptance, entails the use of insulation-piercing self-connection terminals on the contact members used in connector units. These insulation-piercing terminals are usually of forked construction with cutting edges that penetrate the insulation on the conductor wires and that also serve as contact jaws which make the necessary electrical connection from the connector contact to the conductor. With this type of contact terminal, in an electrical connector unit, stripping of the insulation from the conductor is eliminated, along with soldering; the forked terminal element serves both as an insulation cutter and as an electrical contact.

With most previously known connectors utilizing insulation-piercing contact terminals, each conductor wire must be mounted in place in a separate operation. In many instances, it is quite difficult for the workman making the connector installation to maintain all of the previously completed connections while making additional connections; unless separate means are provided for holding each circuit conductor in place after connection is completed, the conductors may easily be displaced while new connections are being made. This is particularly true in the crowded conditions present with miniaturized connectors. Consequently, in most instances it has been necessary to provide individual retainers of one kind or another, requiring a separate operation by the workman for each conductor, in order to assure effective and positive connections for all of the circuit conductors.

The insulation-piercing contact members and the supporting dielectric structures utilized in previously known connector units have not been well adapted to symmetrical contact arrangements. Usually, in connectors in which a substantial number of electrical connections are to be completed, the connector contacts have been arranged in just one or two rows, necessitating the use of elongated connector configurations. For many applications, however, it is preferable to provide substantially symmetrical connector units, particularly where space is at a premium. Moreover, in most of the known constructions, the components for both the plug and receptacle units of a complete connector have required the use of distinctively different component parts. In particular, the dielectric supports for the electrical contacts have been completely different, adding materially to manufacturing costs.

SUMMARY OF THE INVENTION

It is a principal object of the invention, therefore, to provide a new and improved multiple-circuit connector unit construction which inherently and effectively eliminates or minimizes the problems and difficulties of previously known connectors as discussed above.

A particular object of the invention is to provide a new and improved electrical connector unit, incorporating insulation-piercing contact members, in which all terminations are completed simultaneously without the use of any additional tooling or fixturing. This simultaneous termination technique effectively eliminates the possibility that individual conductors may be displaced during sequential completion of electrical connections.

A further object of the invention is to provide a new and improved multiple-circuit electrical connector unit that is inherently adapted to effective utilization of insulation-piercing contact members mounted in a circular array, with all of the conductors for the connector unit being held firmly in place while electrical connections are completed.

A particular object of the invention is to provide a new and improved multiple-circuit electrical connector unit construction in which both the conductive contact members and the dielectric mounts for the contact members can be essentially identical in construction, whether used in a plug unit or a receptacle unit.

A specific object of the invention is to provide a new and improved multiple-circuit electrical connector unit, utilizing insulation-piercing contact members, in which all of the contact members are interlocked with the conductors to which they are electrically connected without requiring individual retainers or interlocks; an important feature of the invention is the utilization of an external housing for the connector unit that performs this interlock function in addition to protection of the connector unit contact members without entailing substantial expense in the manufacture of the connector unit.

Accordingly, the invention relates to an electrical connector unit for use in interconnecting a plurality of electrical circuits. The connector unit comprises an insert of dielectric material including a terminal end, a plurality of conductor retainer apertures extending longitudinally from the terminal end into the insert, in a spaced-apart pattern, and a plurality of terminal guide slots extending into the insert transversely to the retainer apertures; each of the retainer apertures extends into one of the terminal guide slots and is of a size to receive an insulation-covered conductor. A corresponding plurality of conductive contact members are carried by the insert. Each of the contact members includes an active contact element and an insulation-piercing, self-connecting terminal element, each terminal element extending into one of the terminal guide slots, the terminal element being positioned in alignment with but displaced from the associated conductor retainer aperture. The connector unit further comprises actuating means, movable along a surface portion of the insert adjacent its terminal end, for simultaneously moving all of the terminal elements of the contact members relative to their associated retainer apertures to cause each contact terminal element to pierce the insulation and complete an electrical connection to an insulated conductor positioned in the associated aperture.

BRIEF DESCRIPTION OF THE DRAWINGS

FIG. 14 is an exploded isometric projection of the principal components for a connector unit constructed in accordance with another embodiment of the present invention, with the insert for the connector unit in disassembled condition;

FIG. 15 is an elevation view of the assembled insert for the connector unit of FIG. 14;

FIG. 16 is a sectional view of the insert, taken approximately as indicated by line 16—16 in FIG. 15, showing a part of the connector housing;

FIG. 17 is a front end view of the complete assembled connector unit, taken approximately as indicated by line 17—17 in FIG. 16 but drawn to an enlarged scale;

FIG. 18 is a sectional view, drawn to the same scale as FIG. 17, taken approximately as indicated by line 18—18 in FIG. 16;

FIG. 19 is a detail sectional view taken approximately as indicated by line 19—19 in FIG. 15;

FIG. 20 is a sectional elevation view of an assembled connector constructed in accordance with the embodiment of FIGS. 14–19, including both a receptacle unit and a plug unit;

FIG. 21 is an exploded isometric projection of the principal components for a connector unit comprising another embodiment of the invention, showing the insert for the connector unit in disassembled condition;

FIG. 22 is an elevational view of the assembled insert for the connector unit of FIG. 21;

FIG. 23 is a sectional view of a connector unit incorporating an insert of the kind shown in FIGS. 21 and 22, with a part of a mating connector unit also illustrated; and FIG. 24 is a transverse sectional view taken approximately along line 24—24 in FIG. 23, with some of the contact elements omitted for purposes of explanation.

DESCRIPTION OF THE PREFERRED EMBODIMENTS

Figures 1, 2, 3, 4, 5, 6:
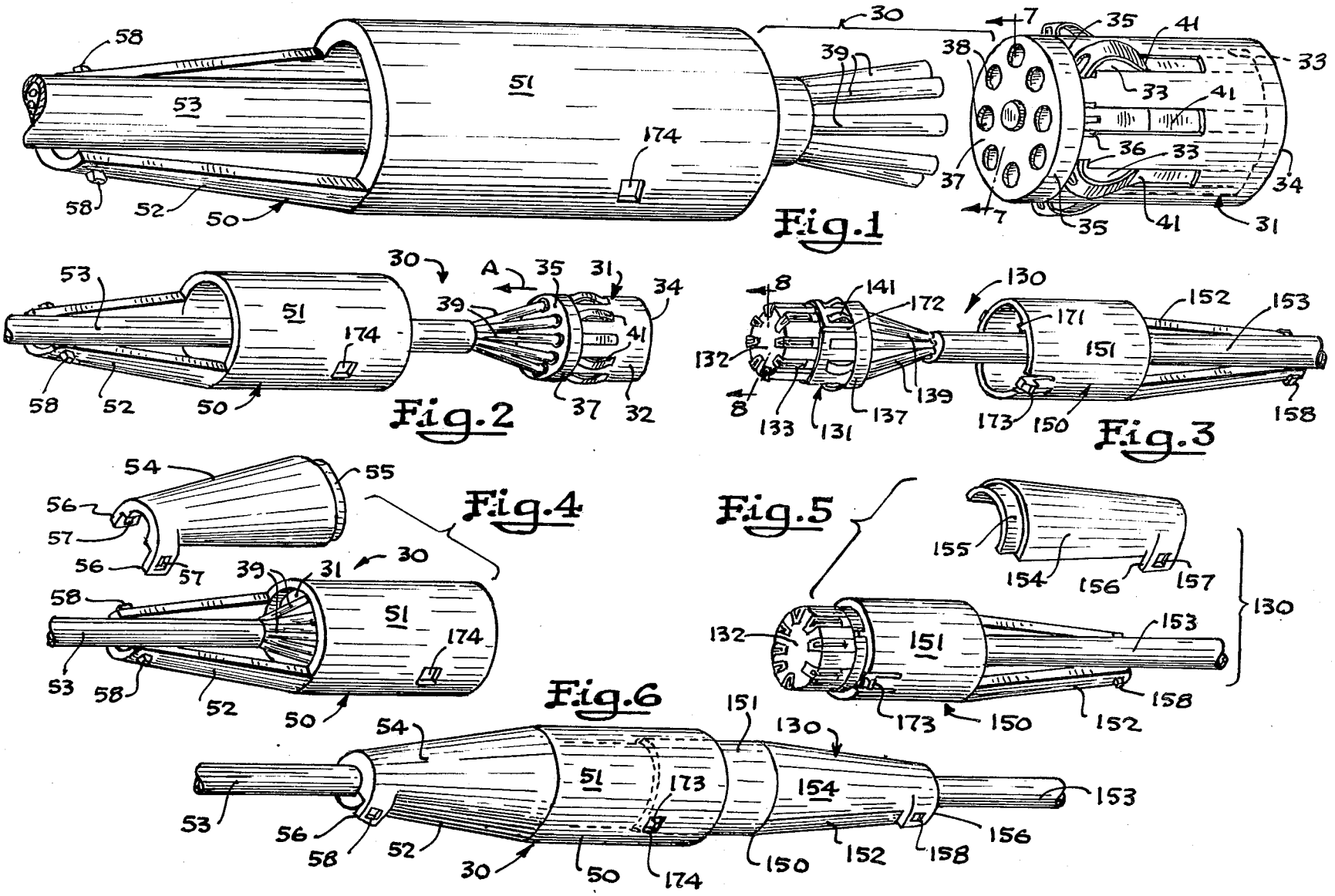
FIG. 1 is an exploded isometric projection of the principal components of a receptacle connector unit constructed in accordance with one embodiment of the invention, prior to assembly on a conductor cable.
FIG. 2 is an isometric projection of the receptacle connector unit components of FIG. 1, drawn to a reduced scale, showing the connector unit in a preliminary stage of assembly.
FIG. 3 is an isometric projection of the principal components of a plug connector unit constructed in accordance with one embodiment of the invention, in the same preliminary stage of assembly as the receptacle unit illustrated in FIG. 2.
FIG. 4 is an exploded isometric projection of the complete receptacle connector unit of FIGS. 1 and 2 in an advanced stage of assembly.
FIG. 5 is an exploded isometric projection of the complete connector unit of FIG. 3 at the same stage of assembly as the receptacle unit of FIG. 4.
FIG. 6 is an isometric projection of the receptacle and plug connector units of the preceding figures with assembly completed and with the plug connector unit inserted in the receptacle connector unit.

FIG. 1 illustrates, in an exploded isometric projection, the principal components for an electrical connector unit 30 for use in interconnecting a plurality of electrical circuits, constructed in accordance with one embodiment of the present invention. Connector unit 30, which is also illustrated in FIGS. 2, 4, 6, 7 and 9, is a receptacle connector unit. The mating plug connector unit is shown in FIGS. 3, 5, 6, 8 and 10.

Figure 7:
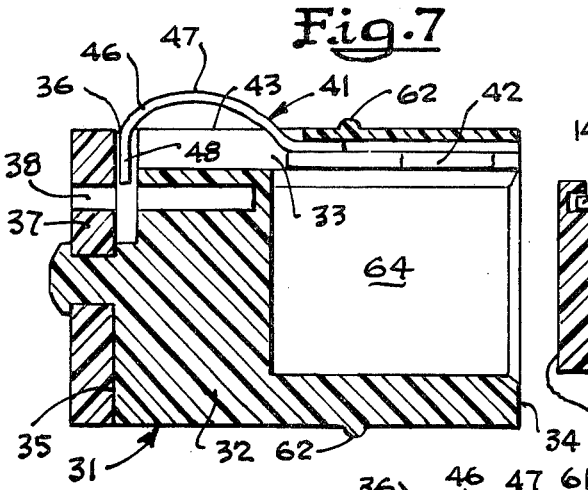
FIG. 7 is a longitudinal section view of the insert for the receptacle connector unit of FIG. 1, taken approximately as indicated by line 7—7 in FIG. 1.
Figure 9:
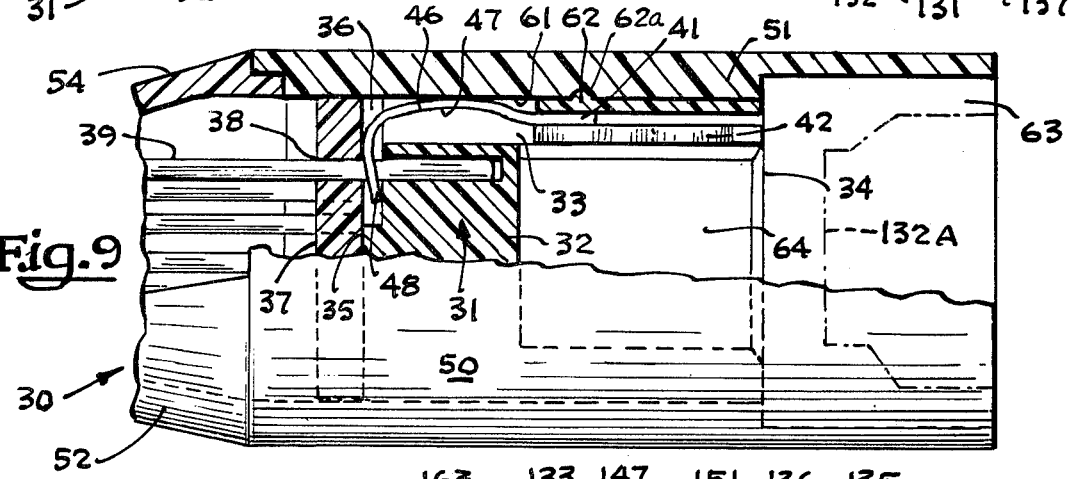
FIG. 9 is an elevation view, partly in cross section, of the complete assembled receptacle connector unit of FIGS. 1, 2 and 4.

The receptacle connector unit 30 includes a connector insert 31 comprising a main insert body 32 of molded dielectric material having a plurality of elongated contact passages 33 formed therein (FIG. 1). Each contact passage 33 extends longitudinally of the insert body 32 from a contact end 34 of insert 31 (FIG. 7) to a point adjacent a terminal end 35 of the insert body 32. As best shown in FIGS. 1, 7 and 9, the end of each contact passage 33 adjacent the terminal end 35 of insert body 32 includes a transverse guide slot 36 that extends radially inwardly of insert 31. That is, each of contact passage 33 extends longitudinally of the insert 32, along the peripheral surface of the insert body 32, whereas the connecting terminal guide slot 36 for the contact passage extends in a radial direction, normal to the main part of the contact passage. The outer walls of the guide slots 36 are formed by a molded dielectric disc 37 that is fixedly mounted on the terminal end 35 of the main molded dielectric insert body 32; a one-piece construction for the complete dielectric insert 31 including the body 32 and the disc 37, can be utilized if desired.

The dielectric insert 31 further includes a plurality of blind-end conductor retainer apertures 38 which extend in the terminal end of the insert. Each conductor retainer aperture 38 extends through disc 37 and beyond the disc, into the main body 32 of the insert 31, intersecting one of the contact passage terminal guide slots 36. Each conductor guide aperture 38 is of a size to receive and retain an insulation-covered conductor 39 (FIGS. 1, 2, 4, 9) in a connection position in which the insulated conductor 39 spans the associated terminal guide slot 36 in the manner illustrated in FIG. 9. The conductor retainer apertures 38 are preferably sized to afford a relatively close fit with the insulated wires 39 so that a conductor 39, once inserted in one of the apertures 38, tends to remain in place.

Figure 11:
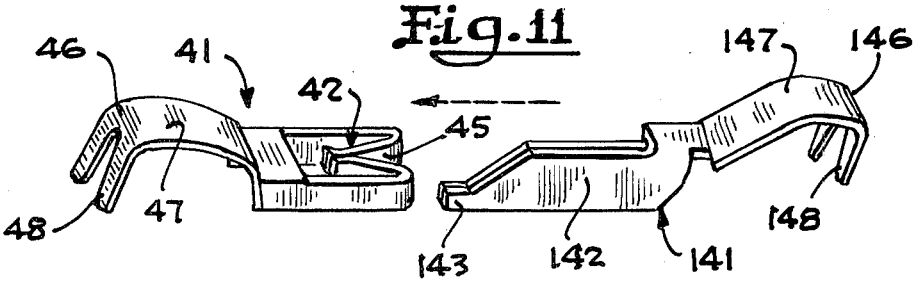
FIG. 11 is an isometric projection illustrating the electrical contact members for the plug and receptacle connector units of the preceding figures.

Connector unit 30 further comprises a plurality of conductive contact members 41, each contact member 41 being fitted into one of the contact passages 33 in insert 31. One of the individual conductive contact members 41 is illustrated in FIG. 11, in an isometric projection; the same contact member 41 is also shown, in substantial detail, in the sectional elevation views of FIGS. 7 and 9. Each contact member 41 includes an active contact element 42 comprising two active contact arms terminating in reverse bends to afford a V-shaped active contact portion 45. In addition, each of the contact members 41 comprises an integral terminal element 46 comprising a spring loop 47 and a bifurcated insulation-piercing self-connecting terminal portion 48 (FIG. 11). As best shown in FIG. 7, the bifurcated terminal portion 48 of terminal element 46 extends into the guide slot 36 of the contact passage 33 in which the contact member 41 is mounted, in aligment with but displaced from the associated conductor retainer aperture 38. The loop portion 47 of terminal element 46 projects outwardly of passage 33, well above the outer surface 43 of the dielectric insert 31.

The receptacle connector unit 30 includes an insulator housing 50, preferably formed of molded dielectric material. As shown in FIG. 1, the main body 51 of the insulator housing 50 is a cylinder; at the outer end, cylinder 51 merges into a tapered hollow conical cable retainer section 52. The insulator housing 50 fits over a cable 53 for the insulated conductors 39, as shown in FIGS. 1, 2, 4 and 6. An additional housing element 54, of tapered hollowed conical configuration complementary to the configuration of the cable retainer section 52, forms a part of the housing 50 for connector unit 30 (FIG. 4). The housing element 54 is provided with a rim 55 that fits into the main cylindrical body 51 of housing 50. Housing element 54 also includes two integral retainer members 56, each having an aperture 57, for engaging two latch lugs 58 on the outer end of the conical cable retainer section 52 of the housing.

The sequence of steps followed in assembling connector unit 30 and completing the electrical connections from the connector unit to the individual insulated conductors 39 of cable 53 is illustrated in FIGS. 1, 2, 4 and 6. At the outset, the external sheath at the end of cable 53 is removed to expose a short length of each of the insulated conductors 39. This end of the cable is inserted through the insulator cylinder 51, in the manner illustrated in FIG. 1. At this stage, the precise location of housing 50 on cable 53 is unimportant, as long as the individual conductors 39 are accessible.

The next step in assembly is to insert conductors 39 into the individual conductor retainer apertures 38 in connector insert 31, as shown in FIG. 2. Preferably, the insulated conductors 39 fit relatively closely into the apertures 38, although this is not essential. It should be noted that the insulation is not stripped from the conductors 39; rather, they are inserted in the retainer apertures 38 with the insulation intact.

With insulated conductors 39 installed in insert 31, the insert is moved into housing 50 as indicated by arrow A in FIG. 2, bringing the connector unit to the stage of assembly illustrated in FIG. 4. Housing element 54 is then mounted on the main body 51 of housing 50 by inserting flange 55 into the open end of body 51, and the retainers 56 are forced down over the end of the housing section 52 to engage the lugs 58 in the apertures 57. This completes the assembly as shown in FIG. 6. The outer ends of the housing elements 52 and 54 should afford a tight fit on the sheath of cable 53, and are preferably provided with internal serrations in order to afford an effective strain release connection between connector unit 30 and cable 53.

One of the critical features of the present invention is the provision of terminal actuating means for simultaneously moving all of the terminal elements 46 of the contact members 41, in connector unit 30, relative to the portions of the conductor retainer apertures 38 that intersect the terminal guide slots 36, to cause the bifurcated portion 48 of each contact terminal element 46 to pierce the insulation on one of the electrical conductors 39, thereby completing all of the electrical connections for the connector unit 30 at one time. In connector unit 30, this terminal actuating means comprises the interior surface 61 of the main body 51 of insulator housing 50, together with the spring loops 47 of the individual contact members 41 (FIGS. 7 and 9); each loop 47 comprises a cam for the terminal element 46 of the contact member 41. That is, in connector 30 the insulator housing 50 itself constitutes a terminal actuating means that simultaneously actuates all of the contact members 41 to complete electrical connections to all of the insulated conductors 39.

The operation of the terminal actuating means, in connector 30, is apparent from FIGS. 7 and 9. When insert 31 is moved into the cylindrical body 51 of housing 50, the cylindrical surface 61 engages all of the cam portion 47 of contact members 41. Consequently, as the insert is forced into the housing, all of the terminal elements 46 of the contact members 41 are driven radially inwardly into their guide slots 36, forcing the bifurcated portion 48 of each terminal element across the intersection of the conductor retainer aperture 38 and the guide slot 36 to the position illustrated in FIG. 9. This relative movement between the terminal element 46 of each contact member 41 and the conductor retainer aperture 38 with which the terminal element is aligned causes the bifurcated portion 48 of the terminal element to pierce the insulation on the conductor 39 in the retainer aperture 38 and completes an electrical connection from the contact member 41 to the insulated conductor 39. Thus, simple insertion of the insert 32 into the insulator housing 50 simultaneously completes all of the electrical connections for the connector unit 30.

The grip on the cable sheath 53 afforded by the strain relief connection between the housing elements 52 and 54 may be sufficient to hold insert 31 in the desired position within housing 50 and may thus afford an interlock to maintain all of the terminal elements 46 of the contact members 41 in the actuated position shown in FIG. 9. On the other hand, it is usually preferable to provide additional interlock means to assure maintenance of the insert 31 in the desired operative position within housing 50. Thus, the insert 31 may be provided with one or more external interlock elements 62 (FIG. 7) fitting into complementary interlock elements 62A within housing 50 (FIG. 9) to assure maintenance of all of the terminal elements 46 in their actuated positions relative to the conductor guide apertures 38 and hence in electrical connection with the conductors 39.

Connector unit 30 is a receptacle unit; housing 50 includes an axial opening 63 leading directly to a smaller axial opening 64 in the contact end 34 of the main body 32 of the dielectric insert 31 (FIG. 9). Furthermore, each of the contact passages 33 opens into opening 64, affording access to the active contact elements 42 of the connector unit 30 through the opening 64. A plug connector unit 130, illustrated in FIGS. 3, 5, 6, 8 and 10, using contact members as shown in FIG. 11, is employed to afford a complete connector assembly.

Figure 8:
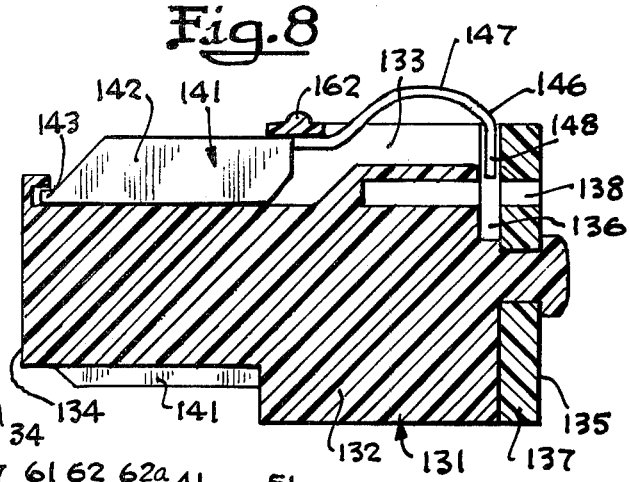
FIG. 8 is a longitudinal section view, drawn to the same scale as FIG. 7, of the insert for the plug connector unit, taken approximately as indicated by line 8—8 in FIG. 3.
Figure 10:
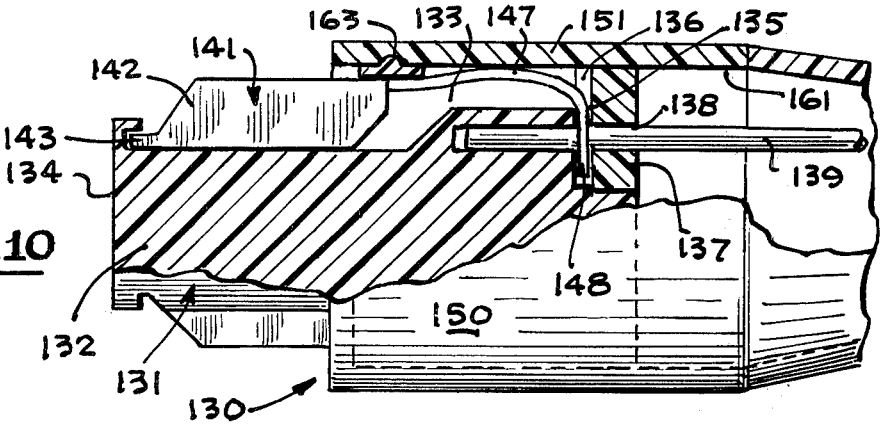
FIG. 10 is an elevation view, partly in cross section, of the complete assembled plug connector unit of FIGS. 3 and 5.

The plug connector unit 130 includes a connector insert 131 comprising a main insert body 132 of molded dielectric material having a plurality of elongated contact passages 133 formed therein (FIGS. 3, 8 and 10). Each contact passage 133 extends longitudinally of the insert body 131 from a contact end 134 of insert 131 (FIG. 8) to a point adjacent a terminal end 135 of the insert body 132. As best shown in FIGS. 8 and 10, the end of each contact passage 133 adjacent the terminal end 135 of insert body 132 includes a transverse guide slot 136 that extends radially inwardly of insert 131. Thus, as in the connector unit, each contact passage 133 in plug unit 130 extends longitudinally of the insert 132, whereas the terminal guide slot 136 for the contact passage extends in a radial direction, normal to the main part of the contact passage 133. The end walls of the guide slots 136 are formed by a molded dielectric disc 137 that is fixedly mounted on the terminal end 135 of the insert 131; a one-piece construction for the complete dielectric insert 131 can be utilized if desired.

A plurality of blind-end conductor retainer apertures 138 extend into the terminal end of the insert 131 (FIGS. 8 and 10). Each aperture 138 extends through disc 137 and beyond the disc, into the main insert body 132, intersecting one of the contact passage terminal guide slots 136. Each conductor guide aperture 138 is of a size to receive and retain an insulation-covered conductor 139 (FIGS. 3 and 10) in a connection position in which the insulated conductor 139 spans the associated terminal guide slot 136 in the manner illustrated in FIG. 10.

Plug connector unit 130 further comprises a plurality of conductive contact members 141, each contact member 141 being fitted into one of the contact passages 133 in insert 131. One of the individual conductive contact members 141 is illustrated in FIG. 11, in an isometric projection; the same contact member 141 is also shown, in substantial detail, in FIGS. 8 and 10. Each contact member 141 includes an active contact element 142 comprising a double thickness of conductive sheet metal, terminating in a retainer element 143. In addition, each of the contact members 141 comprises an integral terminal element 146 comprising a cam loop 147 and a bifurcated insulation-piercing self-connecting terminal portion 148 (FIG. 11). As best shown in FIG. 8, the bifurcated terminal portion 148 of terminal element 146 extends into the guide slot 136 of the contact passage 133 in which the contact member 141 is mounted, in alignment with but displaced from the associated conductor retainer aperture 138. The loop portion 147 of terminal element 146 projects outwardly of passage 133, well above the outer surface of the dielectric insert 131.

Plug connector unit 130 includes a molded dielectric housing 150. The main body of the insulator housing 150 comprises a cylinder 151 merging at one end into a tapered hollow conical cable retainer section 152. Housing 150 fits over a cable 153 for the insulator conductors 139. An additional housing element 154, of tapered hollow conical configuration complementary to the configuration of the cable retainer section 152, forms a part of housing 150 (FIG. 5). The large end of housing element 154 has a rim 155 that fits into the main cylindrical body 151 of housing 150. The small end of housing element 154 includes two retainer members 156 having an aperture 157 for engaging two lugs 158 on the small end of the conical housing section 152.

To assemble plug connector unit 130, the external sheath at the end of cable 153 is removed to expose a short length of each of the insulated conductors 139. The end of the cable is inserted through the insulator housing cylinder 151. The ends of the conductors 139 are then inserted into the individual conductor retainer apertures 138 in connector insert 131, as shown in FIG. 3. As before, the insulation is not stripped from the conductors; they are inserted into the apertures 138 with their insulation intact.

The insert 131 is next moved into housing 150, bringing the connector unit 130 to the stage of assembly illustrated in FIG. 5. The housing element 154 is then mounted on the main body 151 of the housing 150, with the flange 155 projecting into the open end of the housing body 151 and the retainers 156 forced down over the small end of the housing section 152 to engage the lugs 158 in the apertures 157. This completes the assembly as shown in FIG. 6. The small ends of the housing elements 152 and 154 are preferably provided with internal serrations, and fit tightly onto the sheath of cable 153 to afford a strain release connection between the cable and connector unit 130.

In the connector unit 130, the terminal actuating means comprises the interior surface 161 of the cylindrical body 151 of insulator housing 150, together with the cam loops 147 on the individual contact members 141 (FIGS. 8 and 10). When insert 131 is moved into housing 150, the inner cylindrical surface 161 engages each of the contact member cam portions 147. As the insert is forced into the housing, all of the terminal elements 146 of the contact members 141 are driven radially inwardly into their guide slots 136, forcing the bifurcated portion 148 of each terminal element 146 across the intersection of its slot 136 and the related conductor aperture 138 to the position illustrated in FIG. 10. This simultaneous relative movement between the terminal elements and the conductor retainer apertures causes the bifurcated portions 148 of the terminal elements to pierce the insulation on the conductors 139 and completes the requisite electrical connections between the contact members 141 and the conductors 139.

Interlock means are provided to assure maintenance of the insert 131 in the desired operative position within housing 150. Thus, the insert 131 includes one or more external interlock elements 162 (FIG. 8) fitting into complementary interlock elements 163 within housing 150 (FIG. 10) to assure maintenance of all of the terminal elements 146 in their actuated positions relative to the conductor guide apertures 138 and hence in electrical connection with the conductors 139.

In plug connector unit 130, and also in receptacle connector unit 30, it is usually desirable to provide some orienting means for maintaining the connector insert in a fixed angular orientation in the connector unit housing in order to assure accurate completion of the desire circuit connections through the complete connector assembly. This can be readily accomplished by provision of a key 171 in the cylindrical portion 151 of housing 150, engaging in a keyway 172 in the connector unit insert (FIG. 3). A similar key arrangement (not shown) can be employed in the receptacle connector unit 30.

The plug connector unit 130 includes a latch element 173, formed as an integral part of the cylindrical portion 151 of housing 150. The latch element 173 lines up with a latch retainer aperture 174 formed in the cylindrical portion 51 of the housing 50 for the receptacle connector unit 30. When the two connector units 30 and 130 are joined as shown in FIG. 6, the latch element 173 engages in retainer aperture 174, serving the dual purpose of holding the connector units together in operative position and also orienting the two with respect to each other so that the desired circuit connections are completed. Other keying and latching arrangements can be employed as desired.

In the connector units 30 and 130, substantially symmetrical circular contact arrangements can be employed an arrangement that is preferred for many applications. Insulation-piercing self-connecting contact members (41 and 141) are effectively utilized, with no necessity for a workman assembling the connector unit to take special pains in connection with individual conductors being connected to the connector unit. That is, once the insulated conductors 39 or 139 are engaged in the retainer apertures in the inserts 31 or 131, there is little or no likelihood that one conductor will fall out of the insert and thus produce a failure of assembly. The contact members of the individual connector units are readily and rapidly assembled in the connector unit inserts by a simple insertion operation. In each of the connector units, all electrical connections to the external conductors are effected in a single operation that entails only the movement of the connector insert into the connector unit housing for simultaneous completion of all of the electrical connections. The components for a complete electrical connector are relatively simple and inexpensive to manufacture, yet are quite durable and afford long and satisfactory operating life.

Figure 12:
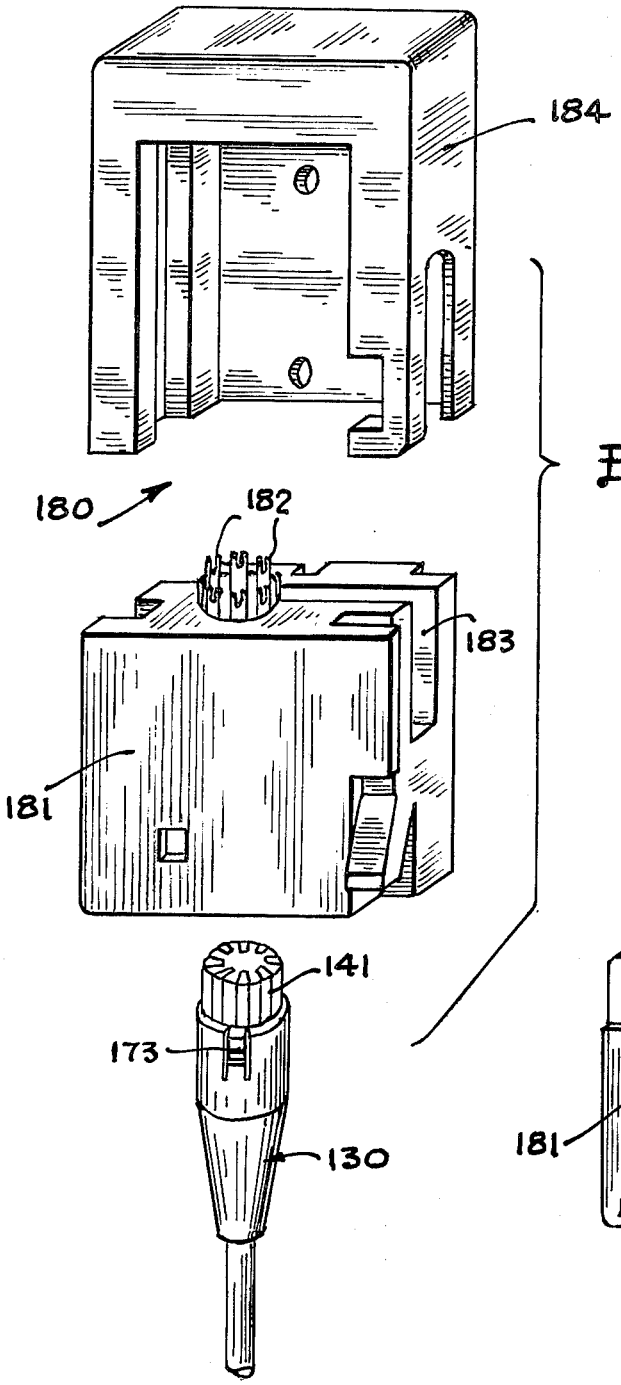
FIG. 12 is an exploded isometric projection of a wall receptacle assembly utilizing a plug connector unit of the kind illustrated in FIGS. 3, 5, 8 and 10.
Figure 13:
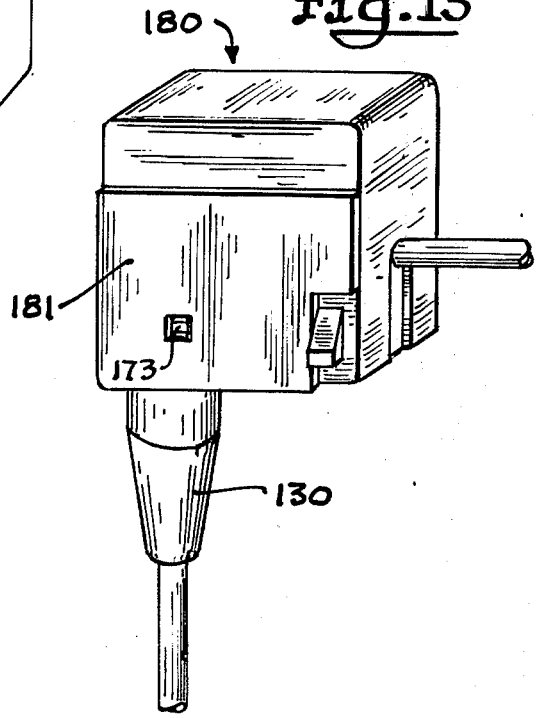
FIG. 13 is an isometric projection of the wall receptacle assembly of FIG. 12 in assembled condition.

FIGS. 12 and 13 illustrate the use of the plug connector unit 130 in conjunction with a wall receptacle unit, suitable for a telephone system or like application. The wall receptacle unit 180, shown partly disassembled in FIG. 12 and assembled in FIG. 13, comprises a molded dielectric contact block 181 in which a plurality of conductive contact members 182 are mounted. The upper ends of the contact members 182 are provided with self-connecting insulation-piercing terminal ends, as shown in FIG. 12. The terminal portions of the contact members 182 are accessible to a cable entrance channel 183 formed in block 181. The ends of the contact members 182 projecting into block 181 are similar in construction to the active contact elements 42 of the contact members 41 (FIG. 11) and are aligned for engagement with the contact members 141 of the connector plug unit 130 when the plug unit is inserted into the mounting block 181, as shown in FIG. 13. A molded dielectric cover 184 is provided for the wall receptacle 181.

The construction shown in FIG. 12 and 13 is merely exemplary of one arrangement for using one of the connector units of the present invention in a complete connector apparatus that employs a second connector unit of substantially different construction. It will be recognized that the orientation and construction of the wall receptacle unit 180 can be changed substantially while still affording an effective arrangement for use of the plug connector unit 130 in an application of this kind. Similar wall-mounted connector units can be readily constructed for use in conjunction with the receptacle connector unit 30 if desired, although it is usually preferable to use the plug connector unit in applications of this type.

FIG. 14 illustrates, in an exploded isometric projection, the principal components for an electrical connector unit 230 for use in interconnecting a plurality of electrical circuits, constructed in accordance with another embodiment of the present invention. Connector unit 230, which is also illustrated in FIGS. 15 through 20, is a plug connector unit. A mating receptacle connector unit 330 is shown in FIG. 20.

The connector unit 230 includes a connector insert 231 comprising a main insert member 232 of molded dielectric material having a plurality of elongated contact passages 233 formed in the outer surface of the insert. Each contact passage 233 extends longitudinally of the insert 231 from a contact end 234 of insert 231 to the opposite, terminal end 235 of the main insert member 232. The end of each contact passage 233 adjacent the terminal end 235 of insert member 232 includes a transverse guide slot 236 that extends radially inwardly of insert 231. That is, each contact passage 233 extends longitudinally of the insert member 232, along its peripheral surface, whereas the connecting terminal guide slot 236 for the contact passage extends in a radial direction, normal to the main part of the contact passage. The outer walls of the guide slots 236 are formed by an auxiliary molded dielectric insert member 237 that is mounted on a shaft 243 formed integrally with the terminal end 235 of the main molded dielectric insert body 232. Member 237 has a small internal key 244 that slides down a keyway 245 in shaft 243 and engages in a short arcuate slot 246, allowing limited arcuate movement of the auxiliary insert member 237 relative to the main insert member 232.

The dielectric insert 231 further includes a plurality of blind-end conductor retainer apertures 238 which extend into the terminal end of the insert. Each conductor retainer aperture 238 includes an outer section 238A that extends through the auxiliary insert member 237 and an inner section 238B that extends into the main body 232 of the insert 231, intersecting one of the contact passage terminal guide slots 236. Each conductor guide aperture 238 is of a size to receive and retain an insulation-covered conductor 239 (FIGS. 14, 16, 18 and 19) in a connection position in which the insulated conductor 239 spans the associated terminal guide slot 236 in the manner illustrated in FIG. 16. The conductor retainer apertures 238 are preferably sized to afford a relatively close fit with the insulated wires 239 so that a conductor 239, once inserted in one of the apertures 238, tends to remain in place.

Connector unit 230 further comprises a plurality of conductive contact members 241, each contact member 241 being fitted into one of the contact passages 233 in insert 231. Each contact member 241 includes an active contact element 242 comprising a single active contact arm formed with a reverse bend to hook into an active contact retainer cavity 247 formed in the contact end 234 of insert 231, in alignment with each contact passage 233 (FIGS. 16 and 17). In addition, each of the contact members 241 comprises an integral bifurcated insulation-piercing self-connecting terminal element 248 (FIGS. 16, 18 and 19). The bifurcated terminal element 248 of each contact member extends into the guide slot 236 of the contact passage 233 in which the contact member 241 is mounted, alignment with the associated conductor retainer aperture 238.

The exterior of connector unit 230 includes an insulator housing 250, formed of molded dielectric material. As shown in FIG. 20, the main body 251 of the insulator housing 250 is a cylinder; at one end, cylinder 251 merges into a tapered hollow conical cable retainer section 252 which extends in a direction normal to the axis of cylinder 251. The insulator housing section 252 fits over a cable 253 for the insulated conductors 239, as shown in FIG. 20. An additional housing element 254, of tapered hollow conical configuration complementary to the configuration of the cable retainer section 252, forms a part of the housing 250 for connector unit 230. The housing element 254 is hinged to the main cylindrical body 251 of housing 250, preferably by an integral hinge 255. Housing elements 252 and 254 may be constructed to afford a tight clamping connection to the sheath of cable 253 for strain relief.

In assembling connector unit 230 and completing the electrical connections from the connector unit to the individual insulated conductors 239 of cable 253, the external sheath at the end of cable 253 is first removed to expose a short length of each of the insulated conductors 239. This end of the cable is then inserted through the insulator cylinder 251. At this stage, the precise location of housing 250 on cable 253 is unimportant, as long as the individual conductors 239 are accessible.

The next step in assembly is to insert conductors 239 into the individual conductor retainer apertures 238 in connector insert 231. The insulated conductors 239 should fit relatively closely into the apertures 238. The insulation is not stripped from the conductors 239; rather, they are inserted in the retainer apertures 238 with the insulation intact. The conductors 239 are inserted in the apertures 238 with the aperture sections 238A and 238B axially aligned. That is, insertion of the conductors 239 into the retainer apertures 238 in the insert 231 is effected with the auxiliary insert member 237 in the alignment shown in FIG. 15, with the aperture sections 238A and 238B axially aligned, so that each conductor passes through one side of the guide slot 236 in alignment with but displaced from the bifurcated terminal portion 248 of the associated contact member 241.

With the insulated conductors 239 inserted into the retainer apertures 238 in insert 231, the auxiliary insert member 237 is rotated in a clockwise direction about shaft 243 to the position shown in FIG. 18, which corresponds to the position illustrated in FIG. 16. The rotational movement of member 237 forces each of the conductors 239 into the befurcation in the terminal element 248 of each of the contact members 241 (FIGS. 18, 19). Thus, the auxiliary insert member 237 functions as a terminal actuating means; the relative rotational movement between the insert members 232 and 237 effects a simultaneous relative movement between all of the contact terminal elements 248 and the portions of the retainer apertures 238 that intersect the terminal guide slots 236. This relative movement between the terminal elements 248 and the conductors 239 in the apertures 238 causes each contact terminal element 248 to pierce the insulation and to complete an electrical connection to one of the insulated conductors 239, as clearly illustrated in FIGS. 16, 18 and 19. It is thus seen that the rotational movement of the auxiliary insert member 237, through the limited arc which is controlled by the key member 244 in its guide slot 246 (FIGS. 16 and 18), affords the same kind of simultaneous connection operation as achieved in the first-described embodiment of the invention.

With the conductors 239 inserted into and electrically connected to the contact members 241 in the insert 231, as described, the housing 250 is moved from the position illustrated in FIG. 14 onto the insert 231, completing the assembly as shown in FIGS. 15–18 and 20. A key member 281 in the cylindrical portion 251 of housing 250 (FIGS. 17 and 18) engages in a keyway 282 in the main insert member 232 to align the insert 231 in the desired orientation within connector unit housing 250. The same key member 281 is aligned with one of the flat surfaces 283 on the auxiliary insert member 237, as shown in FIG. 18, so that relative rotation between the insert members 237 and 232 is precluded once the insert 231 is installed in the housing cylinder 251. Thus, the key 281 and the keyway 282, together with the surface 283, afford an interlock means that maintains the required angular alignment between the insert members 232 and 237, holding all of the terminal elements 248 in actuated position relative to the conductor guide apertures 238, particularly the outer aperture sections 238B, and thus assuring maintenance of the electrical connections to each of the conductors 239.

The assembly operation for connector unit 230, as thus far described, is carried out with the housing element 254 in an open condition as generally indicated by the phantom outline 254A in FIG. 20. Once the insert 231 has been completely inserted into the cylindrical portion 251 of the connector unit housing 250, the housing element 254 can be pivoted about its hinge 255 to the closed condition shown in solid lines in FIG. 20. Suitable interlocking tabs 285 are provided to latch the cover element 254 in the closed condition shown in FIG. 20. As before, the outer ends of the housing elements 252 and 254 should afford a tight grip on the sheath of the cable 253 in order to provide for strain relief.

In connector 230, as in the previously described connector units, some interlock means should be provided for maintaining the insert 231 in the housing 250, in order to assure maintenance of all of the electrical connections. In the illustrated construction, this interlock means comprises a plurality of individual tabs or key elements 262 (FIG. 16) which engage in a series of slots 263 in the contact end 234 of the main insert member 232. Other appropriate interlock means may be provided as desired.

In FIG. 20, the plug connector unit 230 is shown plugged into a mating connector unit 330, which may be a wall receptacle unit. Connector unit 330 comprises a housing 331 with an outwardly opening cavity for receiving the complete cylindrical housing element 251 of the plug connector unit 230. Housing 331 includes an extension 333 in which a second insert 231, which may be identical in construction to that described above, is mounted. Thus, the second insert 231 is equipped with contact members 241 mounted in contact passages 233, and includes an auxiliary insert member 237, all constructed and assembled as described above.

As shown in FIG. 20, the active contact portions 242 of the two connector units 230 and 330 engage to complete the electrical circuits from the plug connector unit 230 to the receptacle connector unit 330. With this construction, therefore, the conductive contact members and the dielectric mounts for the contact members are identical in construction for both the plug unit and the receptacle unit of the complete connector assembly. A latch member 335, formed integrally with the housing member 252 of plug unit 230, engages in a keeper aperture 336 in the housing 331 for receptacle connector unit 330, maintaining the plug connector unit 230 in the operational position illustrated in FIG. 20.

FIG. 21 affords an exploded isometric view of the principal components for an electrical connector unit 430 constructed in accordance with another embodiment of the present invention. Connector unit 430, parts of which are also illustrated in FIGS. 22–24 is a receptacle connector unit. A part of a mating plug connector unit 530 is shown in FIG. 23.

The connector unit 430 includes a connector insert 431 comprising a main insert member 432 of molded dielectric material having a plurality of elongated contact passages 433 formed in the outer surface of the insert. Each contact passage 433 extends longitudinally of the insert 431, from the contact end 434 to the opposite, terminal end 435 of the main insert member 432. At the terminal end 435 of insert member 432, each passage 433 connects with a transverse terminal guide slot 436 that extends radially inwardly of the insert 431. The outer ends of the guide slots 436 are covered by an auxiliary insert member 437, formed of molded dielectric material, that is mounted on a shaft 443 formed integrally with the terminal end 435 of the main insert body 432. Member 437 has a small internal key 444 (see FIG. 22) that slides down a keyway 45 in shaft 443 and engages in a short arcuate slot 446 constituting an extension of keyway 445. This mounting arrangement allows limited arcuate movement of the auxiliary insert member 437 relative to the main insert member 432 when the connector unit is assembled.

The dielectric insert 431 further includes a plurality of blind-end conductor retainer apertures which extend into the terminal end of the insert. Each conductor retainer aperture includes an outer section 438A formed in and extending through the auxiliary insert member 437 and an inner section 438B that extends into the main body 432 of the insert 431, intersecting one of the contact passage terminal guide slots 436. Each conductor guide aperture is of a size to receive and retain an insulation-covered conductor 439 (FIG. 21 and 23) in a connection position in which the insulated conductor 439 spans one of the slots 436 (FIG. 23). The conductor retainer apertures (438A, 438B) are preferably sized to afford a relatively close fit with the insulated wires 439 so that the insulated conductors tend to remain in place in the retainer apertures.

A plurality of conductive contact members 441 are incorporated in the connector unit 430. Each contact member 441 is fitted into one of the contact passages 433 in insert 431. Each contact member 441 includes a central active contact element 442, positioned in the middle of the contact passage 433 and projecting to or near the outer periphery of the main insert member 432. In addition, each of the contact members 441 comprises an integral bifurcated insulation-piercing self-connecting terminal element 448. The bifurcated terminal element 448 of each contact member 441 extends into the guide slot 436 at the end of the contact passage 433 in which the contact member is mounted and is aligned with the associated conductor retainer aperture 438.

The connector unit 430 includes an insulator housing 450, formed of molded dielectric material, employed to protect the insert 431 and to enclose the end 453 of which the insulated conductors 439 are a part. Housing 450 includes a cylindrical main body 451 that merges into a conical cable retainer section 452. These elements of the housing correspond to the housing body 51 and cable retainer section 52 of connector unit 30 (see FIG. 9); accordingly, only a part of each has been illustrated in FIG. 23. An additional housing element 454, having a configuration complementary to the configuration of the cable retainer section 452, forms a part of the housing 450. As in the previously described embodiments, the housing elements 452 and 454 may be constructed to afford a tight clamping connection (not shown) to the sheath of the cable 453 for strain relief.

The end of housing 450 opposite the cable-covering sections 452 and 454 is different in construction from the previously-described connector units, as is shown in FIGS. 23 and 24. The main cylindrical body 451 of housing 450 is of extended length and includes a plurality of elongated contact slots 455 distributed around the internal surface of the housing body 451 in a pattern corresponding to the distribution of the contact passages 433 around the insert 430. However, each contact slot 455 projects a substantial distance beyond the contact end 434 of the insert 431 when the connector unit 430 is assembled, as shown in FIG. 23 and as described more fully hereinafter.

A series of conductive bridging contacts 456 are mounted in the connector unit housing 450; one of the contacts 456 is positioned in each contact slot 455. Each bridging contact 456 has two inwardly-projecting active contact elements 457 and 458, as shown in FIG. 23.

An internally-projecting elongated key element 459 is formed in the main cylindrical body 451 of the connector unit housing 450 (FIGS. 21 and 24). The key element 459 is utilized to orient the insert 431 in the connector housing 450 by engaging in keyways 461 and 462 in the members 432 and 437 of the insert. The key element 459 may also be employed to align the receptacle connector unit 430 with a mating plug connector unit 530, as described below.

The connector unit 430 also includes means for spreading the individual conductors 439 as the conductors emerge from the bundle in the cable 453. This means comprises an extension 464 of the shaft 443 upon which the auxiliary insert member 437 is mounted. The shaft extension 464 is preferably formed with a tapered outer end 465.

In assembling connector unit 430 and completing the electrical connections from the connector unit to the individual insulated conductors 439 of cable 453, the auxiliary insert member 437 is mounted on the shaft 443 projecting from the terminal end 435 of the insert member 432. The external sheath at the end of the cable 453 is removed to expose a short length of each of the insulated conductors 439. The end of the cable is then inserted through the insulator housing cylinder 451, as shown in FIG. 21, and the conductors 439 are each inserted into one of the retainer apertures 238A in the auxiliary connector insert 437. At this time, the insulation is not stripped from the conductors; they are inserted in the retainer apertures 438A, 438B with the insulation intact. Insertion of the conductors 439 into the retainer apertures in the insert 431 is effected with the auxiliary insert member 437 in the alignment shown in FIG. 22, with the aperture sections 438A and 438B axially aligned, so that each conductor passes through one side of the guide slot 436 in alignment with but displaced from the bifurcated terminal portion 448 of the associated contact member 441.

With the insulated conductors 439 inserted into the retainer apertures 438A, 438B in insert 431, the auxiliary insert member 437 is rotated in a clockwise direction about shaft 443, as far as permitted by the engagement of the small key 444 in the slot 446 (FIGS. 21 and 22). The rotational movement of the auxiliary insert member 437 forces each of the conductors 439 into the bifurcation in the terminal element 448 of each of the contact members 441 (FIGS. 23, 24). Thus, the auxiliary insert member 437 functions as a terminal actuating means; the rotational movement of the insert member 437 effectively moves all of the contact terminal elements 448 relative to the portions of the retainer apertures 438A, 438B that intersect the terminal guide slots 436. The resultant relative movement between the terminal elements 448 and the conductors 439 causes each contact terminal element 48 to pierce the insulation and to complete an electrical connection to one of the insulated conductors 439. It is thus seen that the rotational movement of the auxiliary insert member 437, through the limited arc controlled by the key member 444 in its guide slot 446 affords the same kind of simultaneous connection operation as achieved in the previously described embodiments of the invention.

With the conductors 439 inserted into and electrically connected to the contact members 441 in the insert 431, as described, the housing 450 is moved from the position illustrated in FIG. 21 onto the insert 431, to the position shown in FIGS. 23 and 24. The key member 459 in the cylindrical portion 451 of housing 450 engages in the keyways 461 and 462 in the insert members 432 and 437, respectively, aligning the insert 431 in the desired orientation within connector unit housing 450. Thus, relative rotation between the insert members 437 and 432 is precluded once the insert 431 is installed in the housing cylinder 451. Accordingly, it is seen that the key 459 and the keyways 461 and 462 afford an interlock means that maintains the required angular alignment between the insert members 432 and 437, holding all of the terminal elements 448 in actuated position relative to the conductor guide apertures 438A, 438B, thus assuring maintenance of the electrical connections to each of the conductors 439. Furthermore, the key 459 and the keyways 461, 462 limit the mounting of the insert 432 to one specific orientation in the housing 450, affording an effective polarizing means for the connector unit 430.

The assembly operation for connector unit 430 as thus far described, is carried out with the housing element 454 in an open condition. Once the insert 431 has been completely inserted into the cylindrical portion 451 of the connector unit housing 450, the housing element 454 can be closed upon the sheath of the cable 453, just as in the other embodiments of the invention. Suitable interlocking tabs or other latching means may be provided to latch the cover element 454 on the housing 450. As before, the outer ends of the housing elements 452 and 454 should afford a tight grip on the sheath of the cable 453 in order to provide for strain relief.

In connector 430, as in the previously described connector units, some interlock means should be provided for maintaining the insert 431 in the housing 450 in order to assure maintenance of all of the electrical connections to the conductors 439. The interlock means may comprise a plurality of individual tabs or key elements in either the housing or in the insert engaging in a series of slots in the mating member, as in the other embodiments. Other appropriate interlock means may be provided as desired.

In FIG. 23, the receptacle connector unit 23o is shown engaged with a mating plug unit 530. Connector unit 530 comprises a housing 550 from which the contact end 534 of a connector insert 531 projects. The insert 531 is identical in construction to the receptacle unit insert 431. Thus, the plug unit insert 531 is equipped with contact members 441 mounted in contact passages 433, and includes an auxiliary insert member (not shown), all constructed and assembled as described above.

As shown in FIG. 23, the active contact portions 442 of the plug connector unit 530 engage the active contact elements 458 of the receptacle connector unit 430 to complete the electrical circuits from the plug connector unit to the receptacle connector unit. With this construction, therefore, the conductive contact members and the dielectric mounts for the contact members are identical in construction for the inserts in both the plug unit and the receptacle unit of the complete connector assembly, although the connector unit 430 is provided with bridging contacts 456 not employed in the plug connector unit. A suitable latch may be provided to maintain the connector units 430 and 530 engaged in the operational position illustrated in FIG. 23.

When connector unit 430 is being assembled, as described above, the tapered end 465 of the shaft extension 464 is driven into the center of the cable 453. The shaft extension tends to spread the conductors 239 in the cable bundle, facilitating a close, tight fit of the connector unit and the cable.

We claim:

1. An electrical connector unit for receiving in mating engagement a second mating connector unit carrying a plurality of contacts comprising:

an insert of dielectric material including a terminal end, a plurality of conductor retainer apertures extending along an aperture axis longitudinally from said terminal end into said insert, in a spaced-apart pattern, and a plurality of terminal guide slots extending in said insert transversely to said apertures, each of said retainer apertures extending into one of said terminal guide slots and being of a size to receive an insulation-covered conductor;

a corresponding plurality of conductive contact members carried by said insert for mating engagement in a predetermined pattern with the mating contacts carried by said second connector unit, each of said contact members including an active contact element for engagement with one of said mating contacts and an insulation-piercing, self-connecting terminal element, each terminal element extending into a respective one of said terminal guide slots and located in a general plane transverse to the aperture axis of a respective associated one of said retainer apertures;

actuating means, movable along a surface portion of said insert adjacent said terminal end, for simultaneously causing relative transverse movement between all of said terminal elements of said contact members and said conductors to cause each contact terminal element to pierce the insulation of a respective conductor along said plane transverse to the axis of a respective retainer aperture and complete an electrical connection to a respective insulated conductor positioned in the associated aperture, and interlock means for maintaining the actuating means and terminal elements in actuated position relative to said conductor retainer apertures, wherein said insert comprises a main insert member and said actuating means is an auxiliary insert member positioned in juxtaposition to the terminal end of said main insert member and rotationally movable with respect thereto to cause conductors in said retainer apertures to move into said guide slots and into said self-connecting terminal elements.

2. An electrical connector unit according to claim 1 wherein said main insert member carries said contacts and has an end portion defining at least a portion of said guide slots, and said auxiliary insert member includes a disc member rotatably mounted at said end portion including said conductor retainer apertures leading toward said guide slots.

3. An electrical connector unit for receiving in mating engagement a second mating connector unit carrying a plurality of mating contacts comprising:

a main insert of dielectric material including a terminal end, a plurality of conductor retainer apertures extending along an aperture axis longitudinally from said terminal end into said insert, in a spaced-apart pattern, and a plurality of terminal guide slots extending in said insert transversely to said apertures, each of said retainer apertures extending into one of said terminal guide slots and being of a size to receive an insulation-covered conductor;

a corresponding plurality of conductive contact members carried by said insert for mating engagement in a predetermined pattern with the mating contacts carried by said second connector unit, each of said contact members including an active contact element for engagement with one of said mating contacts and an insulation-piercing, self-connecting terminal element, each terminal element extending into one of said terminal guide slots and in a general plane transverse to the axis of a respective associated one of said retainer apertures;

an auxiliary insert member positioned in juxtaposition to the terminal end of said main insert member and rotationally movable with respect thereto for simultaneously causing relative transverse movement between all of said terminal elements of said contact members and said conductors to cause each contact terminal element to pierce the insulation of a respective conductor along a general plane transverse to the axis of a respective retainer aperture and complete an electrical connection to a respective insulated conductor positioned in the associated aperture, interlock means for maintaining said actuating means and terminal elements in actuated position relative to said conductor retainer apertures;

orienting means for controlling the position of said active elements relative said mating contacts carried by said second connector unit, latching means cooperating with said second connector unit for maintaining each of said active elements in mating engagement with a respective one of said mating contacts carried by said second connector unit, a shaft projecting from the terminal end of said main insert member and having said auxiliary insert member journaled thereon, and a tapered extension on said shaft for spreading a bundle of insulation covered conductors at the end of a cable.

4. An electrical connector unit for receiving in mating engagement a second mating connector unit carrying a plurality of contacts comprising:

an insert of dielectric material including a terminal end, a plurality of conductor retainer apertures extending along an aperture axis longitudinally from said terminal end into said insert, in a spaced-apart pattern, and a plurality of terminal guide slots extending in said insert transversely to said apertures, each of said retainer apertures extending into one of said terminal guide slots and being of a size to receive an insulation-covered conductor;

a corresponding plurality of conductive contact members carried by said insert for mating engagement in a predetermined pattern with the mating contacts carried by said second connector unit, each contact members including an active contact element for engagement with one of said mating contacts and an insulation-piercing, self-connecting terminal element, each terminal element extending into a respective one of said terminal guide slots and located in a general plane transverse to the aperture axis of a respective associated one of said retainer apertures;

actuating means, movable along a surface portion of said insert adjacent terminal end, for simultaneously causing relative transverse movement between all of said terminal elements of said contact members and said conductors to cause each contact terminal element to pierce the insulation of a respective conductor along said plane transverse to the axis of a respective retainer aperture and complete an electrical connection to a respective insulated conductor position in the associated aperture, said insert including a main insert member carrying said conductor retainer apertures and said contacts and having an end portion defining at least a portion of said guide slots, and a disc member at said end portion including said conductor retainer apertures leading toward said guide slots, said main insert including a rod-shaped portion having a curved periphery with longitudinally extending contact passages angularly displaced around the curved periphery of said portion and with said contact members individually mounted in said contact passages, wherein said actuating means includes said disc member and said disc member is rotatable with respect to said main insert member for simultaneously moving said terminal elements into electrical connection with said conductors.

5. An electrical connector unit according to claim 4, in which the active contact element of each contact member is located in a portion of its contact passage, said connector unit further comprising a housing encompassing said insert, and a plurality of conductive bridging contacts, mounted in said housing each bridging engaging the active contact element of one of said contact members, and extending beyond said insert to a position engageable with an active contact element of a mating connector unit.

6. An electrical connector unit according to claim 4 wherein said insert includes an outer insulator housing around said terminal elements and interlock means includes complementary key and key-way elements, one of said elements being disposed on said housing.

7. An electrical connector according to claim 6 wherein said insulator housing includes a cable end for closely receiving a multi-conductor cable, and a fastener tightly confining said cable on said cable end to restrict movement of said cable longitudinally of said insert.

8. An electrical connector unit for use in interconnecting a plurality of electrical circuits, comprising:

a connector insert of molded dielectic material including a main insert member with a terminal end and a contact end, and an auxiliary insert member movably mounted on said end for limited movement relative thereto to an actuated position, said main insert member having a plurality of contact passages formed therein, each contact passage extending longitudinally of the main insert member from said terminal end thereof, and each contact passage including a transverse terminal guide slot at the terminal end of the member;

said connector insert further having a corresponding plurality of conductor retainer apertures extending into the terminal end of the main insert member and through said auxiliary insert member, each conductor retainer aperture extending through a respective one of said terminal guide slots along an axis transverse to a respective one of said slots and each conductor retainer aperture being of a size to receive and retain an insulation-covered conductor in a connection position spanning the associated terminal guide slot;

a corresponding plurality of conductive contact members, each contact member being fitted into one contact passage in said insert and including an active contact element and an insulation-piercing self-connecting terminal element, each terminal element extending into the guide slot at the terminal end of the passage and located in a plane transverse to the axis of a respective retainer aperture;

said limited movement of said auxiliary insert member to said actuated position simultaneously causing relative transverse movement between all of said terminal elements of said contact members and said conductors to cause each contact terminal element to pierce the insulation of a respective conductor along said plane transverse to the axis of a respective retainer aperture and complete an electrical connection to a respective insulated conductor inserted into the respective associated conductor guide aperture;

interlock means, including an insulator housing encompassing at least the terminal end of said connector insert, for maintaining said auxiliary insert member in said actuated position, and orienting means including complementary key and key-way elements on said insulator housing and said insert members for ensuring the contact members are oriented; in a predetermined position relative said housing.

9. An electrical connector unit according to claim 8 in which the dielectric insert is substantially circular in cross-section, and in which the contact passages extend parallel to the axis of the dielectric insert and are angularly displaced around the periphery of the insert.

10. An electrical connector unit according to claim 8, in which said insert members are substantially symmetrical with respect to a common axis, and in which the limited movement therebetween is an acute angular movement about said axis.

11. An electrical connector unit according to claim 8, in which said insulator housing includes a main cylindrical section encompassing said main insert connector and a tapered strain relief portion for tightly gripping a cable containing all of said insulated conductors at a location spaced from the terminal end of said main insert member.

12. An electrical connector unit according to claim 8, in which the active contact portions fo said contact members each project beyond the contact end of said main insert member.

13. An electrical connector unit according to claim 8, in which the active contact element of each contact member is located in a central portion of its contact passage, said connector unit further comprising a housing member encompassing said connector insert, and a plurality of conductive bridging contacts, mounted in said housing member, each bridging contact engaging the active contact element of one of said contact members, and extending beyond said connector insert to a position engageable with an active contact element of a mating connector unit.

14. In an electrical connector unit for use in interconnecting a plurality of electrical circuits, comprising:

a connector insert of molded dielectric material including a main insert member with a terminal end and an auxiliary insert member movably mounted on said end for limited movement relative thereto an actuated position, said main insert member having a plurality of contact passages formed therein, each contact passage extending longitudinally of the main insert member from said terminal end thereof, and each contact passage ending in a transverse terminal guide slot at the terminal end of the passage;

said connector insert further having a corresponding plurality of conductor retainer apertures extending into the terminal end of the main insert member and through said auxiliary insert member, each conductor retainer aperture extending through and beyond one of said terminal guide slots and each conductor retainer aperture being of a size to receive and retain an insulation-covered conductor in a connection position spanning the associated terminal guide slots;

a corresponding plurality of conductive contact members, each contact member being fitted into one contact passage in said main insert member and including a contact element and an insulation-piercing self-connecting terminal element, each terminal element extending into the guide slot at the terminal end of the passage;

said limited movement of said auxiliary insert member to said actuated position simultaneously causing relative transverse movement between all of said terminal elements of said contact members and said conductors to cause each contact terminal element to pierce the insulation of a respective conductor and complete an electrical connection to a respective insulated conductor inserted into the associated conductor guide aperture;

interlock means including an insulator housing encompassing at least the terminal end of said insert, for maintaining said auxiliary insert member in said actuated position;

and complementary key and key-way elements on said insulator housing and on both said insert members orienting the contact members in a predetermined position relative said housing.

15. An electrical connector unit for use in interconnecting a plurality of electrical circuits, comprising:

a connector insert of molded dielectric material including a main insert member with a terminal end and a contact end, and an auxiliary insert member movably mounted on said end for limited movement relative thereto to an actuated position, said main insert member having a plurality of contact passages formed therein, each contact passage extending longitudinally of the main insert member from said terminal end thereof, and each contact passage including a transverse terminal guide slot at the terminal end of the member;

said connector insert further having a corresponding plurality of conductor retainer apertures extending into the terminal end of the main insert member and through said auxiliary insert member, each conductor retainer aperture extending through a respective one of said terminal guide slots along an axis transverse to a respective one of said slots and each conductor retainer aperture being of a size to receive and retain an insulation-covered conductor in a connection position spanning the associated terminal guide slot;

a corresponding plurality of conductive contact members, each contact member being fitted into one contact passage in said insert and including a contact element and an insulation-piercing self-connecting terminal element, each terminal element extending into the guide slot at the terminal end of the passage and located in a plane transverse to the axis of a respective retainer aperture;

said limited movement of said auxiliary insert member to said actuated position simultaneously causing relative transverse movement between all of said terminal elements of said contact members and said conductors to cause each contact terminal element to pierce the insulation of a respective conductor along said plane transverse to the axis of a respective retainer aperture and complete an electrical connection to a respective insulated conductor inserted into the respective associated conductor guide aperture;

interlock means, including an insulator housing encompassing at least the terminal end of said connector insert, for maintaining said auxiliary insert member in said actuated position, and orienting means including complementary key and key-way elements on said insulator housing and said insert members for ensuring the contact members are oriented in a predetermined position relative said housing.

16. An electrical connector unit according to claim 15 in which the dielectric insert is substantially circular in cross-section and in which the contact passages extend parallel to the axis of the dielectric insert and are angularly displaced around the periphery of the insert.

17. An electrical connector unit according to claim 15, in which said insert members are substantially symmetrical with respect to a common axis, and in which the limited movement therebetween is an acute angular movement about said axis.

18. An electrical connector unit according to claim 15, in which said insulator housing includes a main cylindrical section encompassing said main insert connector and a tapered strain relief portion for tightly gripping a cable containing all of said insulated conductors at a location spaced from the terminal end of said insert member.

19. An electrical connector unit according to claim 15, in which the contact portions of said contact members each project beyond the contact end of said main insert member.

20. An electrical connector unit according to claim 15, in which the contact element of each contact member is located in a central portion of its contact passage, said connector unit further comprising a housing member encompassing said connector insert, and a plurality of conductive bridging contacts, mounted in said housing member, each bridging contact engaging the contact element of one of said contact members, and extending beyond said connector insert to a position engageable with a contact element of a mating connector unit.

* * * * *